US007518232B2

(12) United States Patent
Yoo

(10) Patent No.: US 7,518,232 B2
(45) Date of Patent: Apr. 14, 2009

(54) PLASMA DISPLAY PANEL

(75) Inventor: Young-Gil Yoo, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/594,936

(22) Filed: Nov. 9, 2006

(65) Prior Publication Data

US 2007/0103058 A1 May 10, 2007

(30) Foreign Application Priority Data

Nov. 9, 2005 (KR) ..... 10-2005-0106989

(51) Int. Cl.
*H01J 17/24* (2006.01)
*H01J 17/49* (2006.01)
*H01J 1/62* (2006.01)

(52) U.S. Cl. ..... 257/700; 313/503; 313/582; 313/586; 313/580; 313/587; 313/562; 313/563; 313/609; 313/495; 257/701; 257/758

(58) Field of Classification Search ..... 257/700, 257/701, 758; 313/503, 582, 585, 580, 587, 313/562, 563, 553, 609, 495; 445/24
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Sinoda et al.

(Continued)

FOREIGN PATENT DOCUMENTS

JP 02-148645 6/1990

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Alexander O Williams
(74) *Attorney, Agent, or Firm*—Robert E. Bushnell, Esq.

(57) ABSTRACT

The present invention relates to a plasma display panel (PDP) that includes a first substrate, an address electrode formed on the first substrate, a dielectric layer formed on the first substrate and covering the address electrode, a barrier rib formed on the dielectric layer, a second substrate, a display electrode formed on the second substrate, a dielectric layer formed on the second substrate and covering the display electrode, and a protection layer formed on the dielectric layer of the second substrate. Discharge cells are defined by barrier ribs, and a phosphor layer is formed in the discharge cells. Barrier ribs contains inorganic adsorbent. When a PDP is operated for a long time, residual carbon or water is generated inside discharge cells, and thereby contaminates a discharge gas contained in the discharge cells. The inorganic adsorbent included in the barrier ribs absorb the residual carbon or water improving efficiency and lifespan of the PDP.

14 Claims, 2 Drawing Sheets

U.S. PATENT DOCUMENTS

| | | | | |
|---|---|---|---|---|
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,630,916 | B1 | 10/2003 | Shinoda | |
| 6,707,436 | B2 | 3/2004 | Setoguchi et al. | |
| 2005/0093774 | A1* | 5/2005 | Tanaka et al. | 345/41 |
| 2005/0212429 | A1* | 9/2005 | Aoki et al. | 313/587 |
| 2006/0071588 | A1* | 4/2006 | Horikawa et al. | 313/486 |
| 2006/0197447 | A1* | 9/2006 | Ravilisetty | 313/582 |
| 2006/0231806 | A1* | 10/2006 | Barker et al. | 252/500 |
| 2006/0232207 | A1* | 10/2006 | Sugimoto et al. | 313/582 |
| 2007/0001602 | A1* | 1/2007 | Miyake et al. | 313/582 |
| 2007/0103078 | A1* | 5/2007 | Son et al. | 313/587 |
| 2007/0126361 | A1* | 6/2007 | Lee | 313/586 |
| 2007/0132391 | A1* | 6/2007 | Miyama et al. | 313/582 |
| 2007/0152591 | A1* | 7/2007 | Yoo | 313/586 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-325888 | 11/2001 |
| JP | 2002-324492 | 11/2002 |
| JP | 2002-358892 | 12/2002 |
| JP | 2004-186021 | 7/2004 |
| KR | 10-2001-0039033 | 5/2001 |
| KR | 10-2006-0058226 | 5/2006 |
| KR | 10-2006-0087633 | 8/2006 |
| KR | 10-2006-0117518 | 11/2006 |

* cited by examiner

PLASMA DISPLAY PANEL

CLAIM OF PRIORITY

This application makes reference to, incorporates the same herein, and claims all benefits accruing under 35 U.S.C. §119 from an application for PLASMA DISPLAY PANEL earlier filled in the Korean Intellectual Property on the $9^{th}$ of Nov. 2005 and there duly assigned Serial No. 10-2005-0106989.

BACKGROUND OF THE INVENTION

1. Field of the Invention

The present invention relates to a plasma display panel (PDP) and a composition for preparing a barrier rib of a PDP. More particularly, the present invention relates to a plasma display panel in which little residual carbon and water remains in a phosphor layer after a firing process, and relates to a composition for preparing a barrier rib.

2. Description of the Related Art

A plasma display panel (PDP) is a flat display device using a plasma phenomenon, which is also called a gas discharge phenomenon, since a discharge is generated in the panel when a potential greater than a certain level is applied between two electrodes separated from each other under a gas atmosphere that is a non-vacuum state.

A plasma display panel is a flat display device that displays images by the use of the gas discharge phenomenon. Recently, a reflective AC driving panel has been generally used for the plasma display panel. A back substrate of the reflective AC driving panel is partitioned by barrier ribs to define discharge cells, and a phosphor layer is formed inside of each of the discharge cells. A front substrate (hereinafter, referred to as the second substrate) includes a display electrode and a dielectric layer covering the display electrode.

To form the phosphor layer in the plasma display panel, a printing process is generally used. A paste for printing the phosphor is mixed with a vehicle, which is a mixture of an organic binder resin and a solvent. The vehicle is to provide the phosphor paste with fluidity. The paste is applied into the discharge cell, and is subjected to a drying process and a firing process to remove the solvent and the organic binder. The organic binder, however, leaves residual carbon after the firing process, and the residual carbon and water remaining in the discharge cell deteriorate the phosphor layer.

Japanese Patent laid-open Publication No. 2004-186021 indicates that the brightness and efficiency of phosphors are deteriorated if the residual carbon is left in the discharge cell, and thereby the reliability including the lifespan of the phosphors is unfavorably affected.

Further, Japanese Patent laid-open Publication No. 2002-358892 discloses a method of applying an adsorbent that is capable of absorbing and decomposing a gas and an impurity produced around the inside of a frit of a gas exhauster or around inside of the frit of the plasma display panel. However, according to the Japanese patents, the impurity is absorbed from the exhausted gas only during the sealing process, so that the method disclosed in the Japanese Patent is insufficient for absorbing all the residual carbon or all the water remaining in the discharge cell.

SUMMARY OF THE INVENTION

The present invention provides a plasma display panel in which residual carbon and water are effectively removed by providing a barrier rib containing an inorganic adsorbent. The present invention also provides a composition for preparing the barrier rib that can be used in a plasma display panel.

According to one embodiment of the present invention, the plasma display panel includes a first substrate, a second substrate spaced apart from the first substrate and facing the first substrate, an address electrode formed on the first substrate, a dielectric layer formed on the first substrate and covering the address electrode, a barrier rib formed on the dielectric layer, a display electrode formed on a surface of the second substrate facing the first substrate, a dielectric layer formed on the surface of the second substrate and covering the display electrode, and a protection layer formed on the dielectric layer of the second substrate. A discharge cell is formed in a space enclosed by the barrier rib, the first substrate, and the second substrate. A gas discharge (an address discharge or a sustain discharge) is performed in the discharge cell. An inorganic adsorbent is included in the barrier rib. The inorganic adsorbent absorbs a residual carbon, water, or an impurity generated in the discharge cell. a phosphor layer formed inside the discharge cell.

The inorganic adsorbent can include an ion exchange zeolite. The inorganic adsorbent can be a zeolite such as a lithium ion exchange mordenite, a sodium ion exchange mordenite, a calcium ion exchange faujasite (X-type), a calcium ion exchange clinoptilolite, or combinations thereof.

The inorganic adsorbent can be dispersed in the barrier rib.

According to another embodiment of the present invention, a composition for preparing a barrier rib includes a glass frit, a polymer resin, an organic solvent, and an inorganic adsorbent.

The polymer resin can include a substance such as an acryl-based resin, an epoxy-based resin, a cellulose-based resin, or combinations thereof. The organic solvent can include butyl cellosolve (BC), butyl carbitol acetate (BCA), terpineol (TP), texanol, or combinations thereof. The inorganic adsorbent can include an ion exchange zeolite. The inorganic adsorbent can be a zeolite such as a lithium ion exchange mordenite, a sodium ion exchange mordenite, a calcium ion exchange faujasite (X-type), a calcium ion exchange clinoptilolite, or combinations thereof.

The composition for preparing the barrier rib can include 100 parts by weight to 150 parts by weight of the polymer resin, 2 parts by weight to 50 parts by weight of the organic solvent, and 1 parts by weight to 10 parts by weight of the inorganic adsorbent, based on 100 parts by weight of the glass frit.

BRIEF DESCRIPTION OF THE DRAWINGS

A more complete appreciation of the present invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

An exemplary embodiment of the present invention will hereinafter be described in detail with reference to the accompanying drawings.

When the plasma display panel (PDP) is operated for a long time, residual carbon or water remaining in a phosphor layer will evaporate due to an increase in temperature in a discharge cell or due to excitation of high energy. Thereby, the residual carbon or water will contaminate a discharge gas or a magnesium oxide (MgO) oxidation layer. In order to prevent the contamination, the barrier rib surrounding the phosphor layer preferably includes a porous material in order to absorb the contaminating material or water.

According to the present invention, the plasma display panel (PDP) includes a first substrate and a second substrate. The first substrate includes an address electrode, a dielectric layer covering the address electrode, a barrier rib formed on the surface of the dielectric layer, and a phosphor layer disposed inside of a discharge cell defined by the barrier rib. The barrier rib includes an inorganic adsorbent. The second substrate includes a display electrode including a transparent electrode and a bus electrode, a dielectric layer covering the display electrode and formed on the surface of the second substrate, and a protection layer formed on the dielectric layer.

Figure 1:
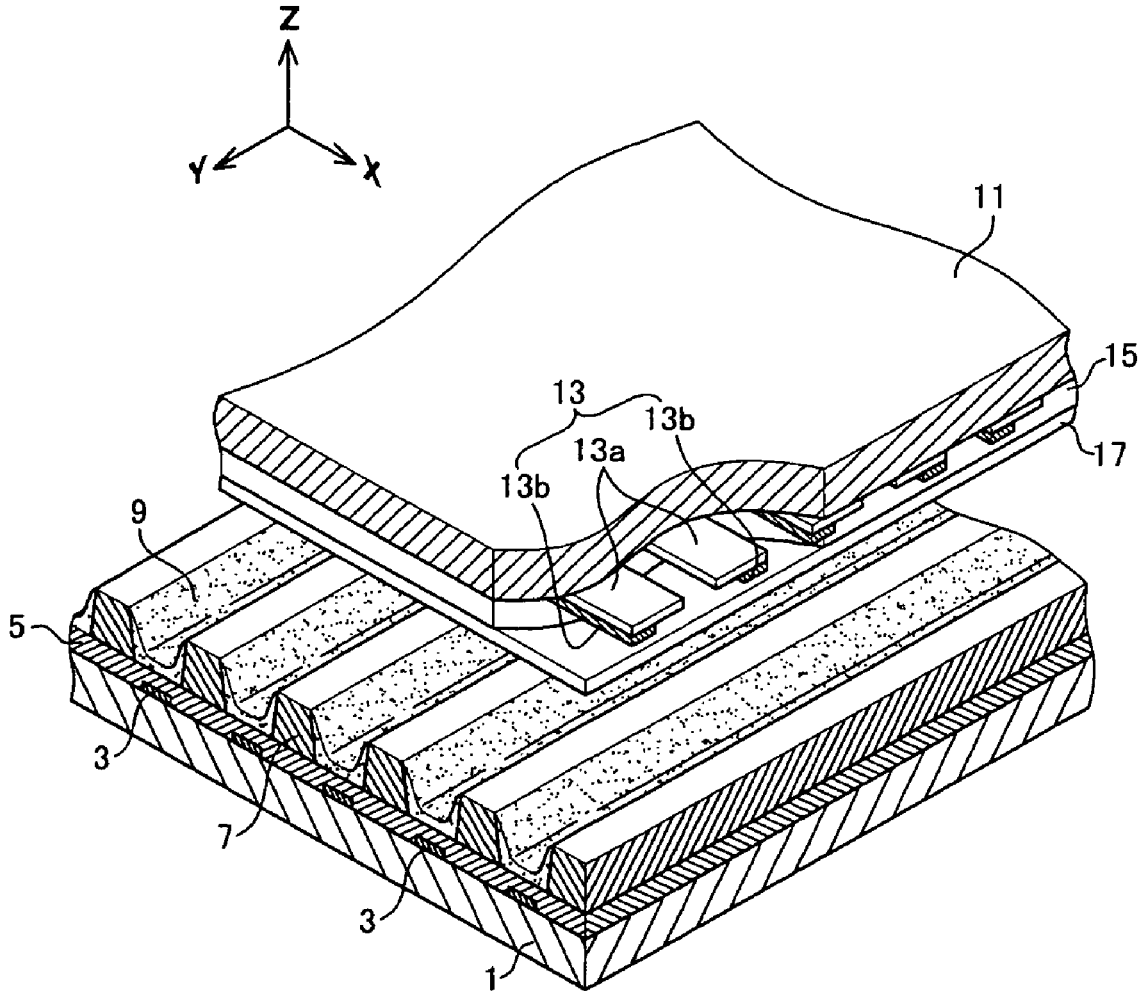
FIG. 1 is a partial exploded perspective view showing an embodiment of a plasma display panel constructed according to the principles of the present invention.

FIG. 1 is a partial perspective view showing a PDP constructed as an embodiment of the present invention. Referring to FIG. 1, the PDP of the present invention includes first substrate 1, a plurality of address electrodes 3 disposed in one direction (along Y axis shown in FIG. 1) on first substrate 1, and dielectric layer 5 disposed on the surface of first substrate 1 covering address electrodes 3. Barrier ribs 7 are formed on dielectric layer 5. Barrier ribs 7 are arranged in a manner that each of address electrodes 3 is positioned between two adjacent barrier ribs 7 as shown in FIG. 1. Barrier rib 7 can be formed in an open type or a closed type. In other words, barrier rib can be formed in a shape of stripes (open type), or can be formed to have rectangular cavities or elliptical cavities (closed type). A discharge cell can be formed in a space enclosed by a barrier rib, the first substrate, and the second substrate. In an open type of barrier rib, the discharge cell can be located between two barrier ribs, and in a closed type of barrier rib, the discharge cell can be located inside the cavities formed in the barrier rib. Red (R), green (G), or blue (B) phosphor layer 9 is disposed in a space formed between two barrier rib 7.

Display electrodes 13, each of which includes a pair of transparent electrode 13*a* and bus electrode 13*b*, are disposed in a direction crossing address electrodes 3 (along X axis shown in FIG. 1) on an surface of second substrate 11 facing first substrate 1. Also, dielectric layer 15 and protection layer 17 are disposed on the surface of second substrate 11 to cover display electrodes 13. Discharge cells are formed at positions where address electrodes 3 cross display electrodes 13, and the discharge cells are filled with a discharge gas.

In the above described structure, address discharge is performed by applying an address voltage (Va) between address electrodes 3 and one of the pair of transparent electrode 13*a* of display electrodes 13. Through the address discharge, discharge cells for displaying images are selected and prepared for a sustain discharge. When a sustain voltage (Vs) is applied between a pair of transparent electrode 13*a* of display electrodes 13, a sustain discharge is performed at the discharge cells selected through the address discharge. During the sustain discharge, ultraviolet rays are generated, and the ultraviolet rays excite a corresponding phosphor layer 9 to thereby cause emission of visible light through second substrate 11. Herein, an address discharge or sustain discharge can be generally referred to as a gas discharge.

However, the plasma display panel of the present invention is not limited to the structure described above. The plasma display panel of the present invention can include various structures that have functionality of plasma display panel, as long as the plasma display panel has a barrier rib.

Figure 2:
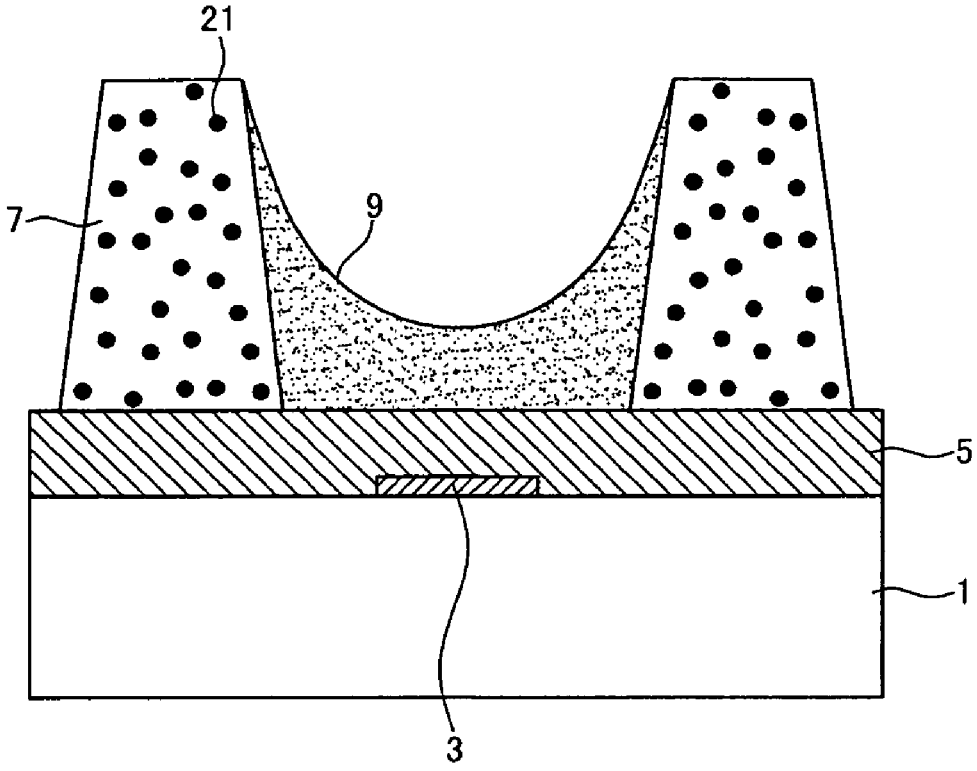
FIG. 2 is a partial cross-sectional view showing a first substrate of the plasma display panel shown in FIG. 1 that includes an inorganic adsorbent inside of barrier rib.

According to the plasma display panel of the present invention, barrier rib 7 preferably includes an inorganic adsorbent dispersed inside of barrier rib 7. FIG. 2 is a partial cross-sectional view showing barrier rib 7, phosphor layer 9, dielectric layer 5, and address electrode 3 of the plasma display panel of the present invention. Barrier rib 7 includes an inorganic adsorbent 21 inside of barrier rib 7. Adsorbent can be dispersed in barrier rib 7, or can be dispersed around a surface region of barrier rib 7. In this embodiment, distribution of adsorbent 7 is preferred. Adsorbent 21 absorbs contaminating materials, such as water or residual carbon, that are generated inside the discharge cells.

Inorganic adsorbent 21 is preferably an ion exchange zeolite and more preferably at least one zeolite such as an ion exchange mordenite, clinoptilolite, or the like. Further, inorganic adsorbent 21 can be a zeolite such as a lithium ion exchange mordenite, a sodium ion exchange mordenite, a calcium ion exchange faujasite (X-type), a calcium ion exchange clinoptilolite, or combinations thereof.

The specific surface area of the inorganic adsorbent included in the barrier rib is preferable between approximately 10 $m^2/g$ and approximately 1500 $m^2/g$, and more preferable between 800 $m^2/g$ and 1200 $m^2/g$. As known in the art, a specific surface area is defined as inverse of surface density (surface density equals mass over surface area). According to one embodiment, inorganic adsorbent 21 can have a specific surface area of 850 $m^2/g$, 900 $m^2/g$, 950 $m^2/g$, 1000 $m^2/g$, 1050 $m^2/g$, 1100 $m^2/g$, or 1150 $m^2/g$. When the specific surface area of the inorganic adsorbent is less than 10 $m^2/g$, the absorbing performance is deteriorated, but when the specific surface area of the inorganic adsorbent is more than 1500 $m^2/g$, it is unfavorable to the process for dispensing the barrier rib paste.

As shown in FIG. 2, in a case that the barrier rib includes the inorganic adsorbent, the amount of the inorganic adsorbent is preferable between about 1 wt % and about 10 wt %, and more preferable at or between 2 wt % and 5 wt % based on the total weight of the barrier rib. The total weight of the barrier rib means sum of the weight of the inorganic adsorbent included in the barrier rib and the weight of the barrier rib measured without the inorganic adsorbent. When the amount of the inorganic absorbent is less than 1 wt %, the performance of absorbing the residual carbon and water is insufficient, but when the amount of the inorganic absorbent is more than 10 wt %, properties of the barrier rib such as the dielectric constant, thermal expansion rate, and so on are unfavorably affected.

The residual carbon includes carbides of an organic material that is oxidized to generate a gas and an impurity during operation of the panel. Specific examples of the residual carbon include water ($H_2O$), carbon dioxide ($CO_2$), or methane ($CH_4$). Herein, an impurity or an impurity gas is defined as a substance that is not involved in the gas discharge (address discharge or sustain discharge) process of a plasma display panel.

The barrier rib for the plasma display panel of one embodiment has a moisture removal efficiency of 80% or higher. The barrier rib for the plasma display panel of another embodiment has a moisture removal efficiency of 80% to 99%. In addition, residual carbon removal efficiency of the barrier rib of one embodiment is 15% or higher. Residual carbon removal efficiency of the barrier rib of another embodiment is 15% to 40%.

A plasma display panel has excellent luminous efficiency when the barrier rib has higher water removal efficiency and residual carbon removal efficiency. Therefore, the higher water removal efficiency and the higher residual carbon removal efficiency are preferable to provide a high quality plasma display.

The barrier rib of the plasma display panel is made of a composition including a glass frit, a polymer resin, an organic solvent, and an inorganic adsorbent. The glass frit of the composition can include any one commonly used in the related art, and it is not limited in the materials disclosed in the present invention. The glass frit can includes lead oxide (PbO), silicon oxide ($SiO_2$), boric oxide ($B_2O_3$), aluminum oxide ($Al_2O_3$), titanium oxide ($TiO_2$) calcium oxide (CaO), zinc oxide (ZnO), or combinations thereof.

The polymer resin is provided as a binder, and includes an acryl based resin, an epoxy-based resin, or a cellulose-based resin. The organic solvent preferably includes butyl cellosolve (BC), butyl carbitol acetate (BCA), terpineol (TP), texanol, or combinations thereof. The mixture of the binder and the organic solvent is called a vehicle. The vehicle also can be used for preparing the phosphor layer. Specific examples of the inorganic absorbent included in the composition for the barrier rib are same as described above.

The composition for making the barrier rib according to the present invention is prepared by adding the inorganic absorbent to the ordinary composition for making a barrier rib that does not include the inorganic adsorbent. The composition for making the barrier rib of the present invention includes 100 parts by weight of the glass frit, 100 to 150 parts by weight of the polymer resin, 2 to 50 parts by weight of the organic solvent, and 1 to 10 parts by weight of the inorganic absorbent. Content of the inorganic adsorbent is preferably 2 to 5 parts by weight. When the amount of the inorganic absorbent is less than 1 part by weight, the performance of absorbing impurities is deteriorated, but when the amount of the inorganic absorbent is more than 10 parts by weight, the physical properties of the barrier rib are deteriorated.

The process of manufacturing a plasma display panel includes the steps of providing a barrier rib by the use of a composition for making a barrier rib, assembling the plasma display panel, sealing, degassing, injecting a gas, and aging. These processes are well-known in the related art, and therefore, the present invention is not limited in a specific process of manufacturing a plasma display panel.

The following examples illustrate the present invention in detail. However, it is understood that the present invention is not limited in these examples.

EXAMPLE 1

40 wt % of a glass frit (manufactured by Daejoo Electron Materials Co., Ltd., DGC562S), 50 wt % of ethyl cellulose, 8 wt % of butylcarbitolacetate, and 2 wt % of lithium ion exchange mordenite (manufactured by Aekyung Chemical Co., Ltd., Valfor 100) were mixed to provide a composition for making a barrier rib.

The composition for making the barrier rib was coated on a dielectric layer, which is formed on the first substrate and address electrodes, to a thickness of 300 μm, and was fired at 550° C. for 30 minutes to provide a barrier rib layer. A photosensitive film (BF704, TOKYO OHKA CHEMICALS) was laminated on the battier rib layer, and then was exposed and developed to make a predetermined pattern of the photosensitive film on the first substrate. The barrier rib layer is exposed through a portion on which the photosensitive film is removed.

The first substrate having the pattern of the photosensitive film was introduced into an etching device equipped with a sprayer. An etching solution, in which hydrochloric acid and sulfuric acid were mixed at a weight ratio of 8:2, was sprayed onto the first substrate to remove exposed portion of the barrier rib layer. The spraying pressure was 3 kgf/$m^2$, the diameter of the spray nozzle was 0.5 mm, the height of the sprayer was 120 mm, and the spraying temperature was 30° C. After finishing the etching process, the rest of the photosensitive film was removed to provide the first substrate with barrier rib that have a predetermined height and shape.

In order to provide a vehicle, 6 parts by weight of ethyl cellulose was mixed with 100 parts by weight of a mixed solvent of butylcarbitol acetate and terpineol, where the mixture ratio of butylcarbitol acetate to terpineol is 4:6. 40 parts by weight of a blue phosphor of $BaMgAl_{10}O_{17}$:Eu was mixed with 100 parts by weight of the vehicle to provide a phosphor paste. The phosphor paste was applied to the surface of the discharge cells that are defined by barrier rib, and was applied to the side surface of the barrier ribs formed on the first substrate to provide a blue phosphor layer. Red and green phosphor layers were provided by the same process as described above using a red phosphor of $(Y,Gd)BO_3$:Eu and a green phosphor of $ZnSiO_4$:Mn, respectively. The first substrate formed with the phosphor layer was dried at 200° C. and fired at 500° C.

Display electrodes, a dielectric layer, and a protection layer, were formed on the second substrate. Then the first substrate and the second substrate were assembled, sealed, degassed, injected with a discharge gas, and then aged to provide a plasma display panel.

EXAMPLE 2

A plasma display panel formed with a barrier rib was fabricated by the same method as described in Example 1, except that 2 wt % of a sodium ion exchange mordenite (manufactured by Aekyung Chemical Co., Ltd., Valfor 100) was used instead of the lithium ion exchange mordenite in the composition for making a barrier rib.

EXAMPLE 3

A plasma display panel formed with a barrier rib was fabricated by the same method as described in Example 1, except that 2 wt % of a calcium ion exchange faujasite (manufactured by Aekyung Chemical Co., Ltd., Folfor 100) was used instead of the lithium ion exchange mordenite in the composition for making a barrier rib.

EXAMPLE 4

A plasma display panel formed with a barrier rib was fabricated by the same method as described in Example 1, except that 2 wt % of a calcium ion exchange clinoptilolite (manufactured by Dongshin) was used instead of the lithium ion exchange mordenite in the composition for making a barrier rib.

COMPARATIVE EXAMPLE 1

A plasma display panel formed with a barrier rib was fabricated by the same method as described in Example 1, except that zeolite was not added in the composition for making a barrier rib.

Water removal efficiency, residual carbon removal efficiency, and lifespan maintaining rate were measured for the plasma display panels which include barrier ribs fabricated according to the methods described in Examples 1 to 4 and Comparative Example 1. Measurement methods are described below, the measurement results are shown in Table 1.

Measurement of Moisture Removal Efficiency

The first substrates manufactured according to the methods described in Examples 1 to 4 and Comparative Example 1 were tested to measure moisture removal efficiency Each of the first substrates was stored in each of identical chambers for 20 hours for a test of moisture removal efficiency. The volume of each of the chambers is 0.5 m×1 m×1 m. The moisture removal efficiency was determined by measuring relative humidity inside the chamber before and after the test. The difference in the relative humidity before and after the test represents the moisture removal efficiency.

Measurement of Residual Carbon Removal Efficiency

The residual carbon removal efficiency was measured by the use of a carbon analyzer (model CS-444). Carbon dioxide ($CO_2$), nitrogen ($N_2$), and sulfur dioxide ($SO_2$) gases generated when the first substrates fabricated according to the methods of Examples 1 to 4 and Comparative Example 1 were fired and introduced into a detector using a carrier of helium gas. The peak was detected by ultrared absorption and thermal conduction rate. The area of the detected peaks was calculated to determine the amount of residual carbon.

Measurement of Lifespan Maintaining Rate

Lifespan maintaining rates were measured for the plasma display panels of Examples 1 to 4 and Comparative Example 1 in an accelerated lifespan test condition by measuring the brightness maintaining rate (%). Brightnesses of the plasma display panels before the test and after the operation for 500 hours are measured and compared to each other.

TABLE 1

| | Moisture removal efficiency (%) | Residual carbon removal efficiency (%) | Lifespan Maintaining Rate (%) |
|---|---|---|---|
| Example 1 | 92 | 35 | 95 |
| Example 2 | 82 | 20 | 91 |
| Example 3 | 87 | 22 | 91 |
| Example 4 | 88 | 18 | 93 |
| Comparative Example 1 | 0 | 0 | 90 |

As shown in Table 1, it is observed that the plasma display panels of the present invention, which include inorganic adsorbent in the barrier ribs, shows improved water removal and residual carbon removal efficiencies. Therefore, the lifespan maintaining rates thereof are superior to that of the plasma display panel that does not have an inorganic adsorbent.

The results shown in Table 1 also show that water removal and residual carbon removal efficiencies of the plasma display panel of the present invention are improved after firing the phosphor layer, so that the phosphor layer of the plasma display panel of the present invention is not deteriorated with time and the luminous efficiency is also improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display panel comprising:

a first substrate;

a second substrate spaced apart from the first substrate and facing the first substrate;

an address electrode formed on the first substrate;

a dielectric layer formed on the first substrate and covering the address electrode;

a barrier rib formed on the dielectric layer; a discharge cell being formed in a space enclosed by the barrier rib, the first substrate, and the second substrate;

a gas discharge being performed in the discharge cell;

an inorganic adsorbent included in the barrier rib for absorbing an impurity generated in the discharge cell, the barrier rib including about 1 wt % to about 10 wt % of the inorganic adsorbent based on the total weight of the barrier rib;

a phosphor layer formed inside the discharge cell;

a display electrode formed on a surface of the second substrate facing the first substrate;

a dielectric layer formed on the surface of the second substrate and covering the display electrode; and a protection layer formed on the dielectric layer of the second substrate.

2. The plasma display panel of claim 1, wherein the inorganic adsorbent includes an ion exchange zeolite.

3. The plasma display panel of claim 1, wherein the inorganic adsorbent is a zeolite selected from the group consisting of a lithium ion exchange mordenite, a sodium ion exchange mordenite, a calcium ion exchange faujasite (X-type), a calcium ion exchange clinoptilolite, and combinations thereof.

4. The plasma display panel of claim 1, wherein the inorganic adsorbent is dispersed in the barrier rib.

5. The plasma display panel of claim 1, wherein the inorganic adsorbent has a specific surface area ranging from about 10 $m^{2/}g$ to about 1500 $m^{2/}g$.

6. The plasma display panel of claim 1, wherein the barrier rib including the inorganic adsorbent has a water removal efficiency ranging from 80% to 99%.

7. The plasma display panel of claim 1, wherein the barrier rib including the inorganic adsorbent has a residual carbon removal efficiency ranging from 15 % to 40%.

8. A plasma display panel, comprising:

a first substrate;

a second substrate spaced apart from the first substrate and facing the first substrate;

an address electrode formed on the first substrate;

a dielectric layer formed on the first substrate and covering the address electrode;

a barrier rib being formed on the dielectric layer to cooperate with the first substrate and the second substrate by enclosing a space forming a discharge cell, the barrier rib being made of a composition including a glass flit and a polymer resin, a gas discharge being performed in the discharge cell;

an inorganic adsorbent included in the barrier rib for absorbing an impurity generated in the discharge cell, the baffler rib including about 1 wt % to about 10. wt % of the inorganic adsorbent based on the total weight of the barrier rib;

a phosphor layer formed inside the discharge cell;

a display electrode formed on a surface of the second substrate facing the first substrate;

a dielectric layer formed on the surface of the second substrate and covering the display electrode; and a protection layer formed on the dielectric layer of the second substrate.

9. The plasma display panel of claim 8, wherein the polymer resin is one selected from the group consisting of an acryl-based resin, an epoxy-based resin, a cellulose-based resin, and combinations thereof.

10. The plasma display panel of claim 8, comprised of the organic solvent being selected from the group consisting of butyl cellosolve (BC), butyl carbitol acetate (BCA), terpineol (TP), texanol, and combinations thereof.

11. The plasma display panel of claim 8, comprised of the inorganic adsorbent including an ion exchange zeolite.

12. The plasma display panel of claim 8, comprised of the inorganic adsorbent being a zeolite selected from the group consisting of a lithium ion exchange mordenite, a sodium ion exchange mordenite, a calcium ion exchange faujasite (X-type), clinoptilolite, and combinations thereof.

13. The plasma display panel of claim 8, with the composition comprised of: about 100 parts by weight to about 150 parts by weight of the polymer resin, about 2 parts by weight to about 50 parts by weight of the organic solvent, and about 1 parts by weight to about 10 parts by weight of the inorganic adsorbent, based on 100 parts by weight of the glass frit.

14. The plasma display panel of claim 1, comprised of the barrier rib being prepared of a composition comprising:

a glass fit;

a polymer resin;

an organic solvent; and an inorganic adsorbent.

* * * * *